US006279200B1

(12) United States Patent
Ferrari et al.

(10) Patent No.: US 6,279,200 B1
(45) Date of Patent: Aug. 28, 2001

(54) HINGE WITH LEVERS FOR FASTENING TO A PIECE OF FURNITURE

(75) Inventors: Franco Ferrari, Località Deviscio, 2, 23900 Lecco; Carlo Migli, Lecco, both of (IT)

(73) Assignee: Franco Ferrari (IT)

( * ) Notice: Subject to any disclaimer, the term of this patent is extended or adjusted under 35 U.S.C. 154(b) by 0 days.

(21) Appl. No.: 09/362,136

(22) Filed: Jul. 28, 1999

(30) Foreign Application Priority Data

Aug. 7, 1998 (IT) ..... MI980563 U

(51) Int. Cl.[7] ..... E05D 5/00; E05D 11/10

(52) U.S. Cl. ..... 16/383; 16/382; 16/332; 16/384

(58) Field of Search ..... 16/324, 382, 383; 411/15, 33

(56) References Cited

U.S. PATENT DOCUMENTS 4,188,685 * 2/1980 Rock and Mages ..... 16/159
4,361,931 * 12/1982 Schenelle et al. ..... 16/252
5,246,322 * 9/1993 Salice ..... 411/15
5,577,297 * 11/1996 Lautenschlager et al. ..... 16/332
5,711,054 * 1/1998 Salice ..... 16/382
5,715,577 * 2/1998 Lautenschlager et al. ..... 16/383
5,979,017 * 11/1999 Karl ..... 16/383
6,073,311 * 6/2000 Lautenschlager ..... 16/383

FOREIGN PATENT DOCUMENTS

0684359A1 5/1995 (EP) .
0691478A 1/1996 (EP) .
0755640A1 5/1996 (EP) .
WO 99/24723 5/1999 (WO) .

* cited by examiner

*Primary Examiner*—James R. Brittain
*Assistant Examiner*—Ruth C. Rodriguez
(74) *Attorney, Agent, or Firm*—Shlesinger Fitzsimmons Shlesinger

(57) ABSTRACT

A hinge for furniture comprises a bowl (11) intended for being flush-recessed into a piece of furniture. Close to one side (20) of the bowl, arms (12) for hinge articulation are pivotally mounted. The bowl is provided with wings (13) having fastening dowels (14), the dowels having operating levers (16) movable between a position for dowel fastening and a position in which dowels are released. In the fastening position the lever (13) extends over a bowl edge (19) opposite to the side close to the arm pivoting point.

6 Claims, 1 Drawing Sheet

HINGE WITH LEVERS FOR FASTENING TO A PIECE OF FURNITURE

The present invention relates to a hinge for furniture provided with a fastening bowl to be flush-recessed into the piece of furniture door and having fastening expansion dowels.

In the known art, hinges provided with bowls having fastening expansion dowels are known. An operating pin internal to the dowel must be rotated to cause dowel expansion. For rotation, the pin usually has a head with fitting seats for a screwdriver.

In order to improve practical use and eliminate need of tools, dowels having operating levers radially projecting from the dowel have been proposed. These levers however, necessarily jut out of the hinge base structure and constitute an easy grip for an accidental release operation. The lever length is at all events limited, due to the requirement of reducing bulkiness of same as well as the risk of getting hold of it and of avoiding any interference with the movable parts of the hinge itself. In spite of that, the aesthetic hinge shape is impaired. In addition, some indication is required to be given for highlighting the correct positioning of the lever in its locking and unlocking condition. This also involves the necessity to supply the user with the essential instructions in order to teach him the correct interpretation of the indications.

It is a general object of the present invention to obviate the above mentioned drawbacks, by providing a hinge with fastening dowels having easy operating levers without any real risk of grip occurrence when they are in their fastening position, without any hindrance to the hinge operation, with an aesthetic impact similar to a traditional hinge devoid of means for operating the fastening devices and in which the correct locking and unlocking position of the fastening means is made immediately clear and perceivable even by an unskilled or unexperienced person.

In view of the above object, in accordance with the invention a hinge for furniture has been conceived which comprises a bowl intended for being flush-recessed into a piece of furniture, hinge articulation arms being pivotally mounted close to one side of the bowl, the bowl being provided with wings having fastening dowels, the dowels having operating levers movable between a dowel fastening position and a dowel release position, characterised in that in the fastening position the lever extends over a bowl edge opposite to said side close to the arm pivoting point.

For better explaining the innovatory principles of the present invention and the advantages it offers over the known art, a possible embodiment of the invention will be described hereinafter by way of non-limiting example with the aid of the accompanying drawings. In the drawings.

Figure 1:
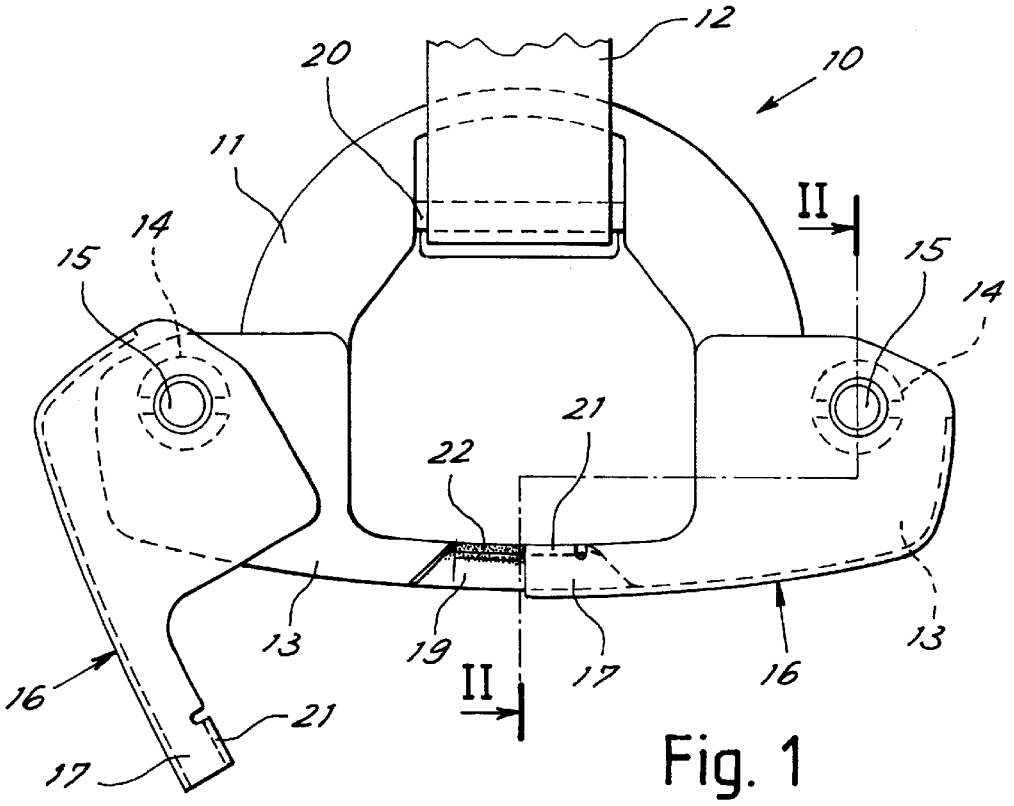
FIG. 1 is a partial plan view of a hinge in accordance with the invention.

With reference to the drawings, a hinge for furniture is shown in FIG. 1 and generally identified by reference numeral 10. This hinge comprises a bowl 11 intended for being flush-recessed into the door of a piece of furniture. Close to one side of the bowl 11, hinge articulation arms 12 are pivotally mounted at 20. The hinge arms with their different articulation pins and their other end intended for fastening to the piece of furniture are not herein shown as they are part of the known art and therefore can be easily conceived by a person skilled in the art. For instance, the arm articulation can be of known types such as the so-called "seven-pin", "four-pin" types and so on, depending on practical requirements.

The bowl laterally has wings 13 provided with expansion dowels 14 for fastening of the bowl to the piece of furniture which is suitably provided with holes. The dowels have operating levers 16 rotating around the dowel axis between a fastening position (shown on the right in FIG. 1) and a release position (shown on the left in FIG. 1).

As clearly shown in FIG. 1, in its fastening position the lever extends with its arm 17 over an edge 19 of the bowl which is opposite to said side close to the arm pivoting point 20.

Advantageously, the lever is such shaped that it covers the corresponding wing when it is in its fastening position, as clearly viewed from FIG. 1 as regards the right lever. In its release position the lever projects from the bowl outline.

Levers are such shaped that they are mirror images of each other, so that they have free ends facing each other when in a fastening position of the dowel, and visually constitute a substantial extension of each other. The free end of each lever carries means 21 for snap-fitting with corresponding means 22 for fitting on said edge 19 of the bowl.

Figure 2:
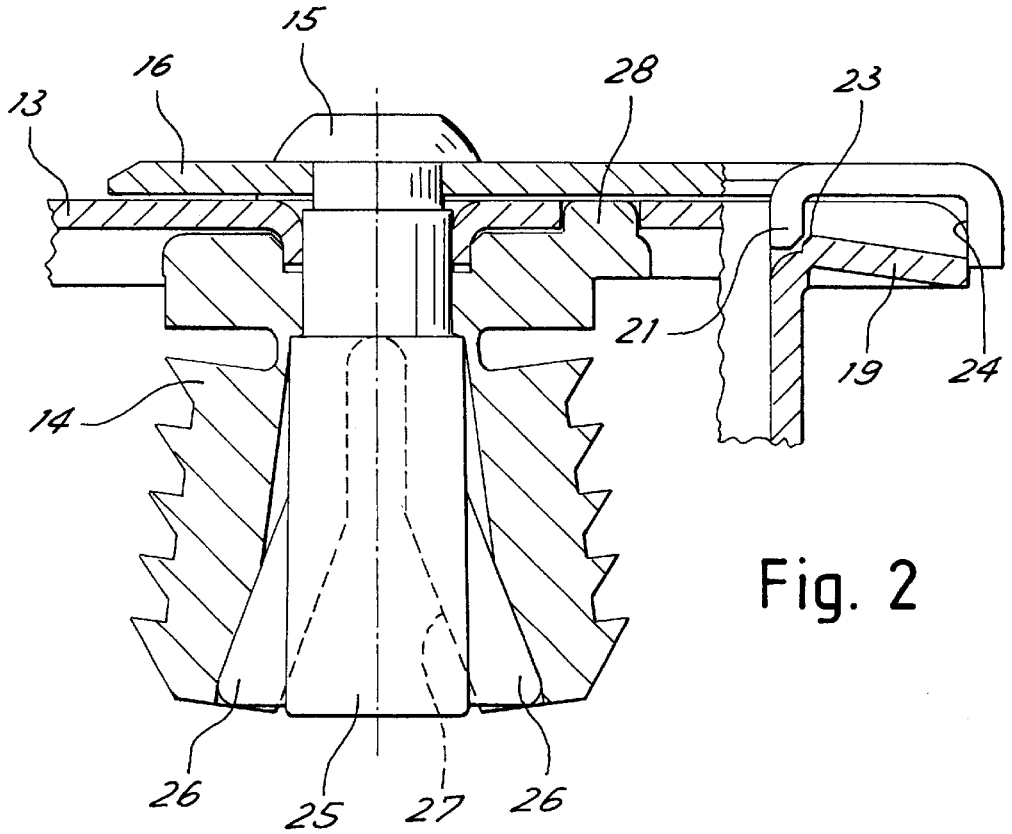
FIG. 2 is a partial view of the hinge sectioned along line II—II in FIG. 1.

As clearly shown in FIG. 2, the fitting means on the lever are formed of an edge 21 of the lever end which is bent to form a fitting tooth in a corresponding groove obtained by drawing 23 in the bowl edge 19. The lever side opposite to tooth 21 can be also bent downwardly to form an abutment 24 to stop movement of the lever against the bowl edge. The bend formed by abutment 24 can extend over most of the lever side to act as a masking for the underlying bowl. The levers are advantageously made of bent metal sheet. As seen in FIG. 2, the dowel has an inner operating pin 25 with an end 15 projecting from the respective wing for connection to the respective lever, by riveting for example. Pin 25 has wings 26 expanding the dowel sides when they rotate to the expansion position. When in a non-expanded position, these wings 26 are received in seats 27 of non-interference with the expandable dowel sides. The dowel has a tooth 28 preventing rotation of its outer expandable portion.

At this point it is apparent how the intended purposes have been reached. Levers can be relatively extended and in a normally expanded position do not at all represent a hindrance and are not provided with projections from the hinge that could facilitate an accidental operation thereof. In addition, everyone can clearly see at once which are the expansion and non-expansion positions of the dowel. The bowl region can have a conformation that appears to be of the traditional type when levers are in their fastening position.

Obviously, the above description of an embodiment applying the innovative principles of the present invention is only given by way of example of these principles and is not to be considered as a limitation of the patent rights herein claimed.

For example, the exact conformation of the dowel can vary depending on practical requirements.

What is claimed is:

1. A hinge for furniture comprising a bowl intended for being flush-recessed into a piece of furniture, hinge articulation arms being pivotally mounted adjacent one side of the bowl, the bowl being provided with a pair of wings each having a fastening dowel mounted therein, the dowels each having an operating lever movable between a dowel fastening position and a dowel release position, and with each lever in the respective fastening position thereof extending at a free end thereof over an edge of the bowl at the side thereof opposite to said one side thereof, and characterized in that each of said levers at said a free end thereof carries fitting means for releasably engaging corresponding fitting means disposed on said edge of said bowl.

2. A hinge as claimed in claim 1, wherein each lever is so shaped that it covers the corresponding wing when the associated dowel is in its fastening position.

3. A hinge as claimed in claim 1, wherein said dowels are two in number, said with levers so shaped that they are mirror images of each other so that their free ends face when the dowel is in its fastening position and constitute a su bstantial extension of each other.

4. A hinge as claimed in claim 1 wherein the fitting means on each of the levers is formed by a respective edge of each lever being bent to form a tooth for releasably fitting in a groove formed by drawing in said bowl edge, this groove forming said corresponding fitting means.

5. A hinge as claimed in claim 1, wherein each of the dowels is an expansion dowel with an inner operating pin having its end projecting from the respective wing for connection to the associated lever.

6. A hinge as claimed in claim 5, wherein the levers are made of bent metal sheet and said pins are riveted thereon.

* * * * *